United States Patent [19]

Carbone

[11] Patent Number: 4,663,606

[45] Date of Patent: May 5, 1987

[54] BIMETAL CIRCUIT BREAKER

[75] Inventor: Douglas C. Carbone, Standish, Me.

[73] Assignee: GTE Products Corporation, Stamford, Conn.

[21] Appl. No.: 843,456

[22] Filed: Mar. 24, 1986

[51] Int. Cl.[4] ..... H01H 37/12; H01H 61/08

[52] U.S. Cl. ..... 337/94; 337/368; 337/378

[58] Field of Search ..... 337/57, 82, 94, 347, 337/360, 368, 378

[56] References Cited

U.S. PATENT DOCUMENTS 4,131,657 12/1978 Ball, Jr. et al. ..... 337/378

*Primary Examiner*—Harold Broome

*Attorney, Agent, or Firm*—James Theodosopoulos

[57] ABSTRACT

A circuit breaker formed of a PMB bimetal fastened to a post and arranged to face against a new contact that is disposed upon a U-shaped calibration bracket. A span is exposed in the U-shaped calibration bracket to enable a calibration probe to break the circuit breaker at a predetermined time to permanently bend it into a fixed position.

6 Claims, 2 Drawing Figures

BIMETAL CIRCUIT BREAKER

FIELD OF THE INVENTION

The present invention relates to electrical circuit breakers of the type employing a positive make and break (PMB) bimetal such as shown in U.S. Pat. No. 2,585,068. Such PMB bimetal circuit breakers include a cantilever section fastened to a U-shaped segment. An example of such PMB bimetal circuit breakers is disclosed in the U.S. Pat. No. 4,521,760, to Carbone.

Calibration of bimetal circuit breakers is extremely important. These circuit breakers are chiefly designed as an over-current protective device to protect D.C. motors from overheating due to larger than normal internal current flow. The circuit breakers, thus, are calibrated to a given trip time range at a specific D.C. current. That is, when these devices are subjected to a specified D.C. current, the device will function in such a way as to open the contacts in a fixed time and tolerances on this time are used to establish an operative range.

Prior to the present invention, bimetal circuit breakers were frequently calibrated by a gram pressure method in which the circuit breaker was forced to open with a given amount of pressure. The gam pressure technique lacks in current sensitivity and it produced correctly calibrated devices with only a 40 percent efficiency. The remaining 60 percent of the circuit breakers had to be recalibrated and again the gram pressure technique yielded only a 40 percent efficiency with the remaining 60 percent having to be calibrated a third time.

SUMMARY OF THE INVENTION

The present circuit breaker construction provides an easy mechanism for calibrating the bimetal thermostats by subjecting the circuit breaker to the specific current for which the circuit breaker is rated for a fixed time and if the contacts do not open, then they are opened mechanically. The construction of the circuit breaker of the present invention allows a calibration probe to easily enter the device and adjust the breaking point.

The circuit breaker of the present invention includes a housing with two electric terminals, each being electrically insulated from the other. A positive make or break bimetal is disposed on the base and attached to one of the electric terminals. The bimetal includes a U-shaped segment that has a pair of legs and a cantilever segment attached to one of the legs. The cantilever segment is attached to the electric terminal. A calibration bracket is attached to the second of the electric terminals and includes a U-shaped bracket with a long leg and a short leg. A contact is disposed on the U-shaped segment of the PMB bimetal and another is disposed on the long leg of the U-shaped calibration bracket. The two contacts are arranged to engage each other in a face-to-face relationship. Preferably, the calibration bracket is arranged so that the second contact and the second electric terminal are disposed on the same side of the calibration bracket. A span is disposed between the U-bend of the bracket and the second contact so that a calibration tool can engage the span easily and change the spacing permanently between them so as to allow for breaking of the circuit in the rated trip time.

DESCRIPTION OF THE DRAWINGS

For a fuller understanding of the nature and desired objects of this invention, reference should be made to the following detailed description taking in conjunction with the accompanying drawings wherein like reference characters refer to corresponding parts throughout the several views of the preferred embodiment of the invention and wherein.

DESCRIPTION OF THE PREFERRED EMBODIMENTS

Figure 2:
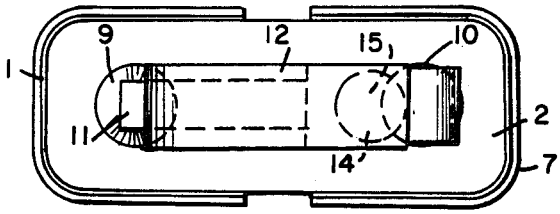
FIG. 2 is a top cross sectional view of the circuit breaker of the present invention taken along the lines 2—2 of FIG. 1.
Figure 1:
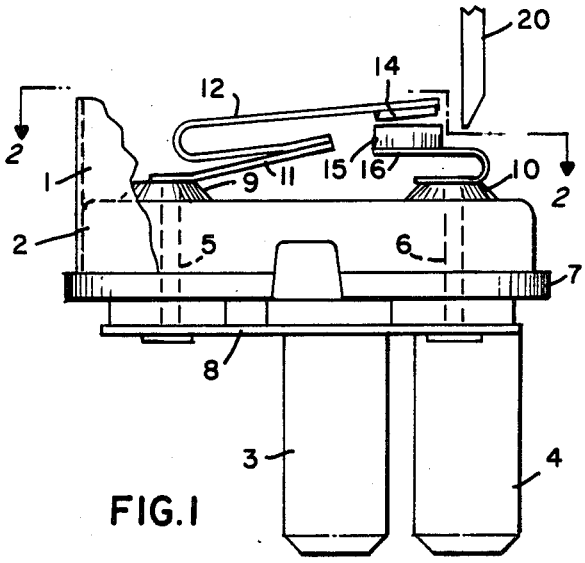
FIG. 1 is a side elevational view, partially in cross section, which shows the PMB bimetal and the calibration bracket of the present invention.

As shown in the drawing, one embodiment of a circuit breaker in accordance with this invention comprises a metal cover 1 and a base section 2. A pair of terminals 3 and 4 are attached to the base 2 by means of posts 5 and 6. A flange 7 is disposed on the base 2 to receive cover 1. Posts 5 and 6 are welded to appropriately shaped holes in terminals 3 and 4. Post 5 is offset from post 6 and the location of terminal 3 by means of a spacer 8. The posts 5 and 6 extend through holes in the base 2 and through mounts 9 and 10.

A cantilever segment 11 of the PMB bimetal is fastened, by welding for example, to the end of post 5. Similarly fastened to the other end of the cantilever section 11 is a U-shaped segment 12 of the PMB bimetal. A first contact 14 is welded to the end of U-shaped segment 12 and when the circuit breaker is closed, it swings to engage and make electrical contact with a fixed contact 15 that is welded to a calibration bracket 16. The first contact 14 and the second contact 15 engage each other in a face-to-face relationship to provide the electrical connection when the circuit breaker is closed.

The PMB bimetal formed of the U-shaped segment 12 and the cantilever segment 11 provides a positive make and break action and is less susceptible to ambient temperatures because of its construction. The upper surface of cantilever section 11 is the high expansion layer of the bimetal and the lower surface is the low expansion layer. For U-shaped segment 12, the high expansion layer is the inner surface of the "U" and the lower expansion layer is the outer surface. Thus, if the ambient temperature increases, the right hand end of cantilever section 11 will move towards the base section 2 while the U-shaped segment will tend to open up, that is, try to move first contact 14 away from fixed second contact 15.

As has been mentioned previously, the construction of the calibration bracket 16 is such that it can easily receive a calibration probe 20 to adjust the point where the circuit will be broken. The calibration bracket 16 is preferably shaped in a "U" with a long leg and short leg. The short leg of the "U" is attached to the post 6 by welding for example, or other appropriate attachment means. The long leg of the "U" has the second contact 15 disposed at its distal end. The second contact 15 is spaced from the bend of the "U" so as to provide a span between the "U" and the contact to make an area available to receive a calibration probe 20 which can force the bending of the calibration bracket 16 and a breaking of the circuit.

In the circuit breaker of the present invention, the cantilever section 11 was 300 mils by 75 mils wide and made of 6 mil type 6650 bimetal. U-shaped segment 12 had an overall length of 600 mils (before bending into a U) by 150 mils wide and was also made of 6 mil type 6650 bimetal. The calibration bracket 16 is formed of 1010 cold rolled steel. The bracket is formed as mentioned above in the shape of a "U" from 0.015 mil stock. The length of the long leg, measured at the center of the "U", is 0.3 inches and the short leg, again measured to the center of the "U", is 0.2 inches. The space between the long leg and the short leg of the calibration bracket is preferably, 0.030 inches with the "U" having an inside radius of 0.03 inches. The cold rolled steel forming the calibration bracket is 0.2 inches wide.

In testing the calibration bracket, the circuit breaker assembly was inserted into a calibration fixture which electrically connects terminal 3 and terminal 4 to a power supply. The calibration sequence was electrically initiated and the calibration probe 20 was moved into position, just making contact with the calibration bracket 16. The calibration probe 20 then stopped. The current to the terminals 3 and 4 was initiated and the timing sequence was started. If, at the end of the allotted time, that is, a time which is rated to trip the circuit breaker at a specific D.C. current, the contacts are still closed, then the calibration probe 20 bends the calibration bracket 16 until the contacts open. The calibration sequence is then completed.

A fifty piece sample of devices was constructed and calibrated to a trip time of 22.8 seconds with a possible variation of 1.1 seconds. For a 7.0 second range, this is greater than a 99.73 percent yield from the calibrating device. I found that through the use of the calibration technique herein disclosed and the bimetal circuit metal of the present invention, that the repeatability of the experiment was 0.1 seconds.

As will be recognized, this calibration method is superior to the previously discovered gram pressure method in two specific ways. First, the present technique utilizes the mode of operation of the circuit breaker as the actual calibration method. That is, devices function as a current-trip timer device and are calibrated with a specific current for a specific time. The gram pressure method relied upon a correlation between contact pressure and current-trip time which cannot be defined as readily. Secondly, this calibration method has a greater sensitivity due to the location of the calibration point. For example, a 0.001 inch motion of the calibration probe will tend to bend the calibration bracket and move the contact 0.001 inches. However, a 0.001 inch motion of the compensator as previously used in the gram pressure method, tended to move the contacts 0.002 inches. The loss is mechanical advantage with the new method becomes a gain in sensitivity.

It is apparent that modifications and changes can be made within the spirit and scope of the present invention but it is my intention, however, only to be limited by the appended claims.

As my invention I claim.

1. A circuit breaker comprising:

a housing including a base for supporting two electric terminals, the terminals being electrically insulated from each other; and a PMB bimetal disposed on said base, said bimetal comprising a U-shaped segment having a pair of legs and a cantilever segment attached to one of said legs;

means for attaching said cantilever segment to the first of said electric terminals; and calibration means disposed on the second electric terminal, said calibration means including a U-shaped bracket with a long leg and a short leg, said short leg being attached to the second of said electric terminals; and a first contact means disposed on said U-shaped segment and a second contact means disposed on said long leg, the two contact means being arranged to engage each other in a face to face relationship.

2. The circuit breaker according to claim 1 wherein said second contact and the connection to the second electric terminal are disposed on the same side of said calibration bracket.

3. The circuit breaker according to claim 1 or 2 wherein there is a span between the U-bend of the bracket and the second contact means whereby to receive a calibration tool to change the spacing between the two contacts.

4. A circuit breaker comprising:

a housing including a base for supporting two electric terminals, the two terminals being insulated from each other; and a U-shaped PMB bimetal segment disposed on said base, said bimetal segment having a first contact disposed at one end thereof; and means for attaching the other end of said bimetal to the first of the electric terminals; and U-shaped calibration means disposed on the second electric terminal, said calibration means having a second contact disposed adjacent the end thereof, said first and second contacts being arranged to engage each other in a face to face relationship, and deformable means in said calibration means disposed between said second electric terminal and said second contact, whereby to receive a calibration tool to change the spacing between the two contacts.

5. The circuit breaker according to claim 4 wherein the PMB bimetal further includes a cantilever section, one end of said cantilever section being attached to said first electric terminal and the other end being attached to said U-shaped bimetal segment.

6. The circuit breaker according to claim 4 or 5 wherein the calibration means is a U-shaped bracket, having a long leg and a short leg, said long leg carrying said second contact and said short leg being attached to said second electrical contact.

* * * * *